United States Patent [19]

Patel et al.

[11] Patent Number: 4,738,231

[45] Date of Patent: Apr. 19, 1988

[54] ONE-PIECE ROCKER ARM WITH INSERT

[75] Inventors: Ramanlal L. Patel, Maumee; Joseph L. Wherry, Perrysburg, both of Ohio

[73] Assignee: Toledo Stamping & Manufacturing Company, Toledo, Ohio

[21] Appl. No.: 465,163

[22] Filed: Feb. 9, 1983

Related U.S. Application Data

[63] Continuation-in-part of Ser. No. 412,102, Aug. 27, 1982, abandoned, which is a continuation-in-part of Ser. No. 134,447, Mar. 27, 1980, Pat. No. 4,346,678.

[51] Int. Cl.[4] ..... F01L 1/18

[52] U.S. Cl. ..... 123/90.44; 123/90.39

[58] Field of Search ..... 123/90.39, 90.44

[56] References Cited

U.S. PATENT DOCUMENTS

| | | | |
|---|---|---|---|
| 2,982,273 | 5/1961 | Bergmann | 123/90.39 |
| 3,563,216 | 2/1971 | Uemura | 123/90.44 |
| 3,690,958 | 9/1972 | Thompson | 123/90.44 X |
| 3,791,355 | 2/1974 | Bergmann et al. | 123/90.44 X |
| 4,359,019 | 11/1982 | Guede | 123/90.44 X |

*Primary Examiner*—Michael Koczo

*Assistant Examiner*—Peggy Neils

*Attorney, Agent, or Firm*—Allen D. Gutchess, Jr.

[57] ABSTRACT

A one-piece, cold-formed rocker arm of the cam-follower type is provided. The rocker arm includes a one-piece metal body cold-formed from a metal blank generally in the shape of a rectangular parallelepiped. The rocker arm has a rounded recess formed at one end portion of the metal body to receive a lifter post having an end on which the rocker arm can pivot. An opening flaring upwardly and outwardly from the rounded recess extends through the metal body for lubricating purposes. The metal body also has an additional recess at another end portion to receive an end of a valve stem. An intermediate portion of the body is convex, facing away from the recesses and has a shallow recess in which is received a hardened metal insert to be engaged by a cam. The side of the body opposite the shallow recess has a shallow rectangular projection extending outwardly. The metal body can have gussets extending between the one end portion and the convex portion of the body or the body can have side flanges extending downwardly therefrom, to provide strength and stiffness.

20 Claims, 2 Drawing Sheets

ONE-PIECE ROCKER ARM WITH INSERT

This application is a continuation-in-part of U.S. application Ser. No. 412,102 filed Aug. 27, 1982 now abandoned which, in turn, is a continuation-in-part of U.S. application Ser. No. 134,447 filed Mar. 27, 1980, now U.S. Pat. No. 4,346,678.

This invention relates to a one-piece, cold-formed rocker arm of the cam follower type.

The present invention provides a one-piece rocker arm of the cam-follower type which is made by cold forming operations, including stamping, coining, staking, and backpacking. The new rocker arm includes a one-piece metal body formed from a metal blank of generally rectangular parallelepiped shape. The new rocker arm is strong and yet lighter in weight than many of those heretofore known. The metal body requires no assembly and fewer heat treating steps, being of one-piece construction and does not require any machining.

A first, rounded recess is formed in one end portion of the metal body and communicates with an opening extending upwardly and outwardly through the body. A second recess is formed in the other end portion of the metal body and is of rectangular shape in transverse cross section. The first, rounded recess receives the upper end of a lifter post and the second recess receives an end of a valve stem. An intermediate portion of the body is generally convex, facing away from the recesses. The convex portion has a shallow rectangular recess therein which receives a hard metal wear insert to be engaged by a cam, so that the rocker arm can operate the valve stem with the lifter post being a pivot. The generally concave portion of the metal body opposite the shallow recess has a shallow, rectangular projection corresponding in size and shape to the shallow recess so that the intermediate portion of the metal body has a substantially uniform amount of metal throughout its length.

The hard metal insert in the shallow recess can be welded in place, at least at its ends, by electron beam or laser welding. The side edges of the inserts can also be welded for additional strength. When the insert is affixed in the recess by these techniques, a softer metal layer is preferably located in the bottom of the shallow recess beneath the insert. This layer provides a "cushion" which can deform to make up any distortion between the hard insert and the rocker arm body. The softer layer also provides firm support and helps to position the insert properly relative to the body, the insert being struck or upset after it is in position. When the hard metal insert is affixed in the shallow recess by brazing, the additional soft metal layer is not needed.

In one embodiment of the invention the one-piece metal body is made of a thicker metal blank of generally rectangular parallelepiped shape with the ends narrowed somewhat and having a thickness in the order of 0.30 to 0.35 inch. This body has gussets between the end portion having the rounded recess and the intermediate, convex portion for increased strength and stiffness.

A second embodiment of the invention is made from a thinner metal blank of generally rectangular parallelepiped shape. This has a thickness in the order of 0.15–0.17 inch. The second embodiment has side flanges or skirts formed downwardly to provide additional stiffness.

It is, therefore, a principal object of the invention to provide a one-piece, cold-formed rocker arm having the features and advantages discussed above.

Another object of the invention is to provide a one-piece, cold-formed rocker arm having a hard wear insert in a shallow recess thereof.

Other objects and advantages of the invention will be apparent from the following detailed description of preferred embodiments thereof, reference being made to the accompanying drawings, in which.

Figure 4:
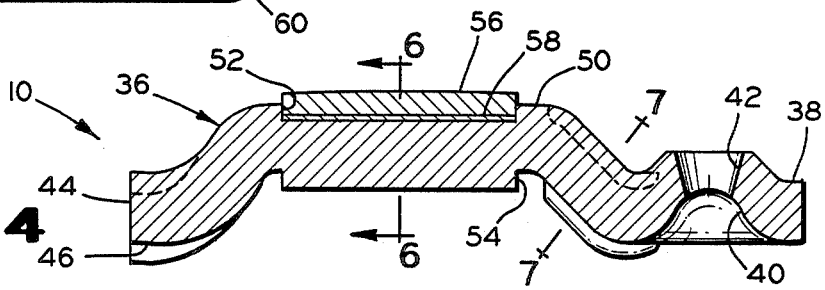
FIG. 4 is a view in longitudinal cross section taken along the line 4—4 of FIG. 3.
Figure 5:
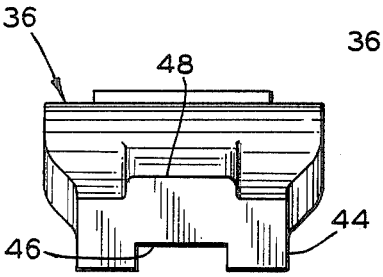
FIG. 5 is a left end view of the rocker arm.
Figure 6:
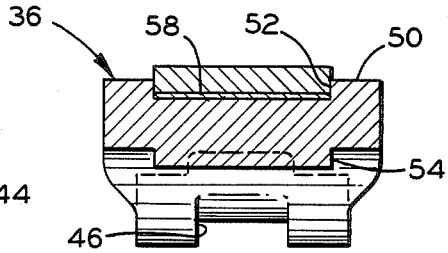
Figure 7:
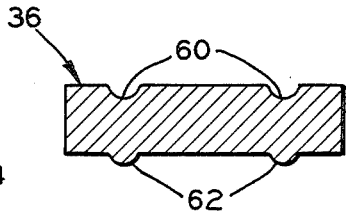
Figure 8:
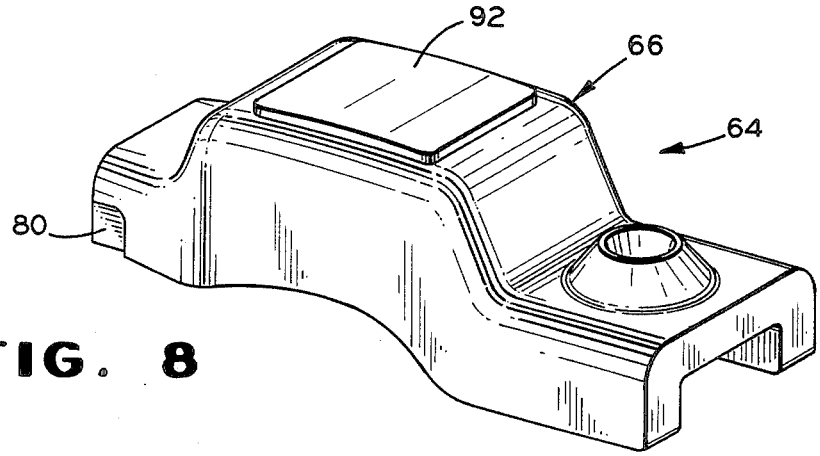
Figure 9:
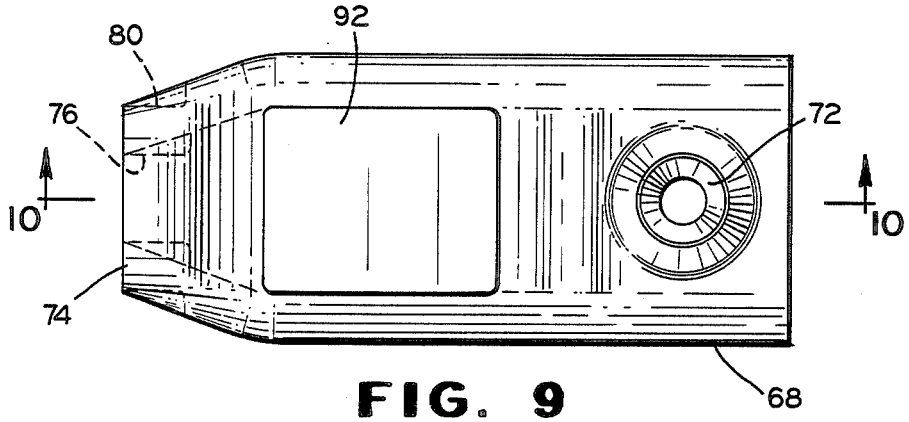
Figure 10:
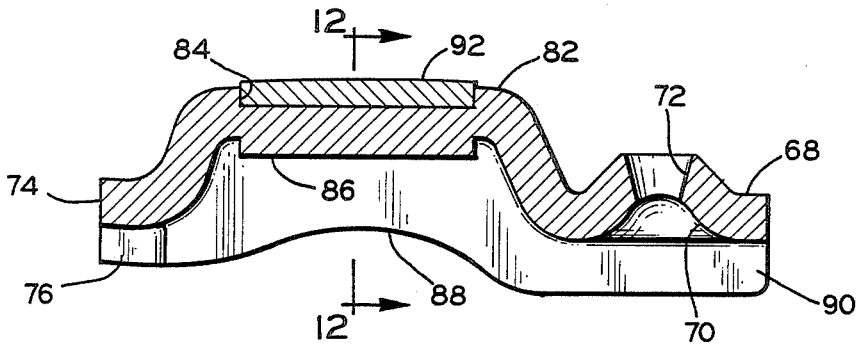
Figure 11:
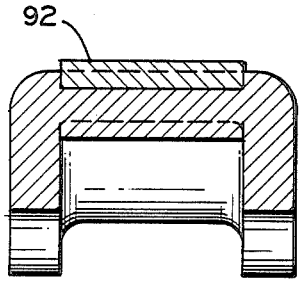

FIGS. 6 and 7 are views in transverse cross section taken along the lines 6—6 and 7—7 of FIG. 4;

FIG. 8 is a view in perspective of a modified rocker arm in accordance with the invention;

FIG. 9 is a top view of the rocker arm of FIG. 8;

FIG. 10 is a view in longitudinal cross section taken along the line 10—10 of FIG. 9;

FIG. 11 is a left end view of the rocker arm of FIGS. 8–10; and

Figure 12:
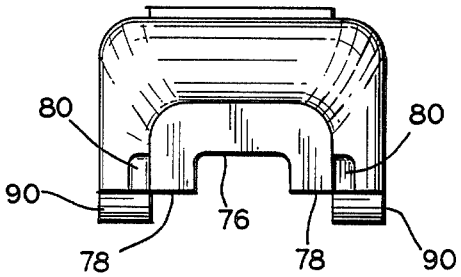

FIG. 12 is a view in transverse cross section taken along the line 12—12 of FIG. 10.

Figure 1:
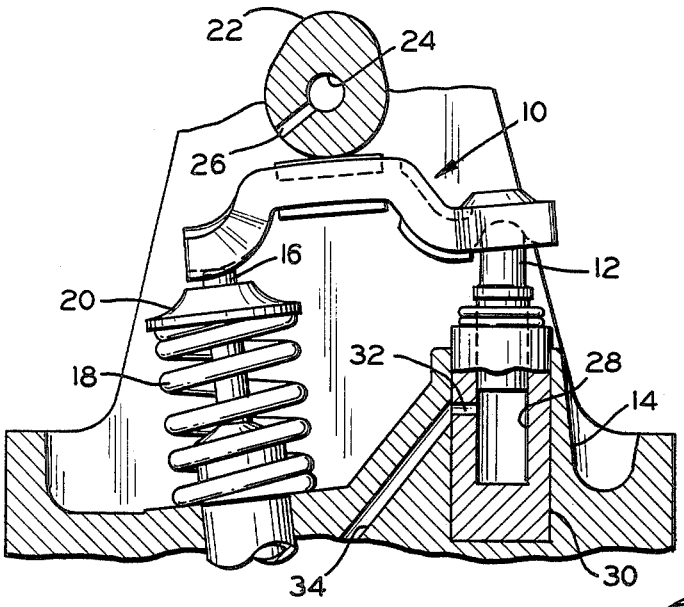
FIG. 1 is a somewhat schematic view in cross section, with portions in elevation, of valve actuating mechanism including a rocker arm in accordance with the invention.
Figure 2:
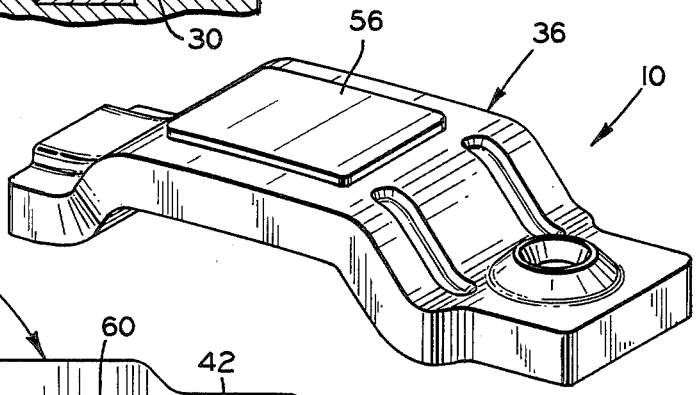
FIG. 2 is an enlarged view in perspective of the rocker arm of FIG. 1.
Figure 3:
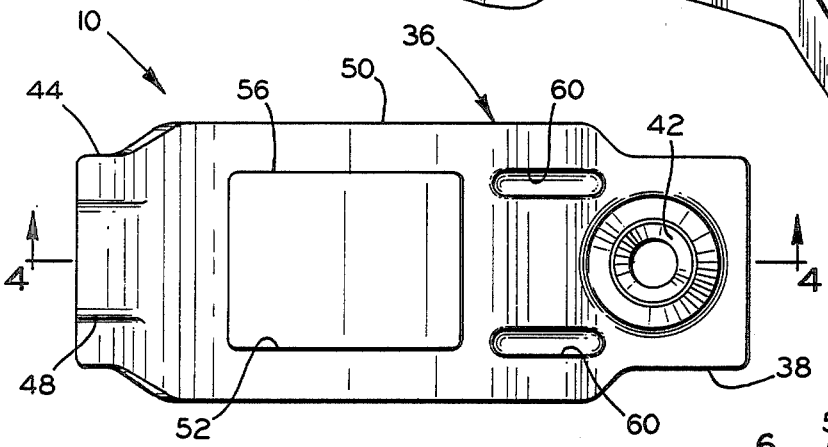
FIG. 3 is a top view of the rocker arm of FIG. 2.

Referring particularly to FIG. 1, a rocker arm of the cam-follower type is indicated at 10 and has one end portion received on a rocker arm fulcrum or lifter post 12 extending upwardly from a cylinder head 14 of an internal combustion engine. The other end portion of the rocker arm 10 engages an upper end of a valve stem 16. The valve stem extends upwardly from the cylinder head 14 through a coiled compression spring 18 located therearound and which is seated against the cylinder head and against a retainer seat 20 mounted on the stem 16. An overhead cam 22 engages an intermediate portion of the rocker arm 10 to cause a valve located at the lower end of the valve stem 16 to open and close as the stem is moved longitudinally by the rocker arm 10. Oil or other lubricating fluid is supplied through a central passage 24 in the cam shaft of the cam 22 and to a transverse passage 26 from which it flows to the intermediate surface of the rocker arm 10 for lubricating purposes.

The lifter post or fulcrum 12 is slidably carried in a chamber 28 of a cylinder 30. The post 12 is urged upwardly by fluid such as oil under pressure in the chamber 28 which is supplied through a small port 32 from a supply passage 34. The post 12 thereby can yield somewhat when the cam 22 is rotated. In practice, the post 12 moves down slightly at the high lobe of the cam 22 to provide a zero lash adjustment for the rocker arm 10. The port 32 is of a size to provide for controlled leakage of the oil from the chamber 28 to control pressure of the oil therein. Oil can also be supplied from the passage 34 up to the intermediate surface of the rocker arm 10 for lubricating purposes.

Referring more particularly to FIGS. 2–7, the rocker arm 10 includes a one-piece, cold-formed metal body 36 which preferably is made by cold-forming operations, such as stamping, coining, staking, and backpacking. A first end portion 38 of the body is reduced in width somewhat to reduce weight and has a first, rounded recess 40 to receive the upper, rounded end of the lifter post 12. A lubricating or oil opening 42 communicates with the rounded recess 40 and flares upwardly and outwardly to the opposite side of the end portion 38. This opening provides a reservoir for oil which can be collected therein and supplied to the surfaces of the recess 40 and the lifter post 12.

Another end portion 44 of the body 36 also is reduced in width to effect a further savings in weight. The end portion 44 has a central recess 46 therein of generally rectangular shape in transverse cross section. This recess can be coined to maintain close tolerances when the recess receives the upper end of the valve stem 16. This prevents transverse or lateral motion of the rocker arm 10 during operation. When the recess 46 is formed, a corresponding projection 48 of generally rectangular shape in cross section is formed on the upper surface of the end portion 44 of the body 36. This tends to maintain the same amount of metal throughout the length of the end portion 44 with the projection 48 also adding to the strength and stiffness of the end portion 44 of the rocker arm.

An intermediate portion 50 of the metal body 36 is of generally inverted U-shape in longitudinal cross section, being generally convex on top and generally concave on the bottom. A shallow recess 52 of rectangular shape is formed on the convex side of the intermediate portion 50 and a shallow rectangular projection 54 of the same general size and shape is formed on the concave side. These are formed by coining and the amount of metal throughout the length of the intermediate portion 50 remains approximately constant, as thus seen in cross section in FIG. 6.

A long-wearing, hard metal insert 56, preferably of powdered metal, such as a hard or hardened iron alloy, is positioned in the shallow recess 52 and is affixed therein. Since the recess 52 encloses the insert 56 on all four sides, and since it is in contact with the overhead cam 22, the insert could not be separated from the rocker arm 10 even if it became loose in the metal body 36. The insert 56 can be affixed in the recess 52 preferably by electron beam or laser welding at the ends of the insert. Laser welding produces extremely localized heating which will not destroy the hardness of the insert or of the adjacent portion of the metal body. For additional stiffness, the insert 56 can also be welded along the side edges thereof. Brazing can also be used.

When the insert is welded to the metal body 36 a softer metal layer or sheet 58 is preferably located in the recess 52 below the insert 56. The layer can also have perforations therein to aid in the deformation of this layer. After the layer 58 and the insert 56 are placed in the recess 52, a uniform pressure is applied through the assembly to increase the dimensional accuracy of the insert relative to the metal piece by a striking or upsetting operation. The layer 58 deforms during this operation to act as a cushion between the harder components so as to accommodate any distortion between parts and to provide a firm support for the insert. After this operation, the parts are then claped together and the insert affixed to the body as discussed above.

To increase the stiffness of the rocker arm 10, a pair of gussets in the form of parallel ridges 60 and grooves 62 therebelow are formed on opposite sides of the body and extend between the end portion 38 near the flared opening 42 and the recess 40, and the intermediate portion 50 of the body.

A somewhat modified rocker arm 64 in accordance with the invention is shown in FIGS. 8–12. The rocker arm 10 is made from a relatively thick metal blank of generally rectangular parallelepiped shape, having a thickness of about 0.25 to 0.45 inch and preferably about 0.30 to 0.35 inch. The rocker arm 66 is made from a blank of the same shape but substantially thinner, being from 0.130 to 0.200 inch, and preferably from about 0.160 to 0.170 inch. Whereas the rocker arm 10 achieves much of its stiffness and strength through the thickness of the metal and the gussets 60, the rocker arm 66 achieves much of its strength and stiffness through side flanges or skirts.

The rocker arm 64 includes a one-piece, cold-formed metal body 66. The body has a first end portion 68 in which is formed a first rounded recess 70. An opening 72 flares upwardly and outwardly from the recess and extends to the opposite side of the end portion 68, forming a reservoir to supply oil to the surfaces of the recess 70 and the post 12.

A second end portion 74 of the body 66 has a recess 76 formed therein to receive the upper end of the valve stem 16. Side flanges 78 are formed downwardly to form part of the recess 76 which is of generally rectangular shape in transverse cross section. Further, the outer surfaces of the side flanges 78 are staked to form recesses or dimples 80 and form the sides of the recess 76 to close tolerances to prevent excess transverse or lateral movement of the rocker 64 on the valve stem 16.

An intermediate portion 82 of the rocker arm body 56 is similar in shape to the intermediate portion 50 of the rocker arm body 36, having a shallow rectangular upper recess 84 and a lower shallow rectangular projection 86. However, the intermediate portion 82 also has side flanges 88 extending downwardly therefrom for strength and stiffness with these forming a continuation of the side flanges 78 of the recess 76. The flanges 88 also extend to the end portion 68 of the rocker arm body and form narrower side flanges 90 at the sides of the rounded recess 70.

A long-wearing, hard metal insert 92 is located in the shallow recess 84 and can be similar to the insert 56. In this instance, the insert 92 is affixed in the recess 84 by brazing. The braze metal forms a sifficient cushion around the insert 92 that the softer metal layer 58 of the embodiment of FIGS. 1–7 can be eliminated.

From the above, it will be seen that the rocker arm in accordance with the invention is lighter in weight than many heretofore known and yet is designed to be sufficiently stiff and to have adequate strength. The one-piece metal body 36 or 66 also eliminates several steps involved with two-piece bodies heretofore known including assembly operations and certain heat-treating operations.

Various modifications of the above-described embodiments of the invention will be apparent to those skilled in the art and it is to be understood that such modifications can be made without departing from the scope of the invention, if they are within the spirit and the tenor of the accompanying claims.

We claim:

1. A one-piece, cold-formed rocker arm of the cam-follower type comprising a one-piece metal body having a rounded recess in a first end portion thereof to receive an end of a lifter post on which said rocker arm can pivot, said end portion thereof having an opening extending therethrough communicating with said rounded recess and said opening being flared outwardly in a direction away from said recess to form an oil reservoir, said body having an additional recess of rectangular transverse cross-sectional shape at a second end portion thereof to receive an end of a valve stem, said body having an intermediate generally convex portion facing away from said recesses, said convex portion having a shallow rectangular recess therein defined by four peripheral side walls, said body having a shallow projection of rectangular shape in longitudinal cross section on the side directly opposite said shallow recess, a long-wearing metal insert in said shallow recess to be engaged by a cam, said metal insert being prevented from sideways movement by said side walls of said body, and means affixing said metal insert in said shallow recess.

2. A one-piece rocker arm according to claim 1 characterized by said metal insert being affixed in said shallow recess by metal at the ends of said insert.

3. A one-piece rocker arm according to claim 1 characterized by a metal layer which is softer than said metal insert positioned in said shallow recess underneath said metal insert.

4. A one-piece rocker arm according to claim 1 characterized by braze metal affixing said metal insert in said shallow recess.

5. A one-piece rocker arm according to claim 1 characterized by said metal body having two spaced, parallel ridges extending from near said rounded recess toward said shallow projection and said body having two spaced parallel grooves opposite said ridges extending from near said flared opening toward said metal insert.

6. A one-piece rocker arm according to claim 1 characterized by said body having side flanges extending along both sides of said body from said first end portion to said second end portion.

7. A one-piece rocker arm according to claim 1 characterized by said second end portion having shallow projection of generally rectangular transverse cross-sectional shape on the side opposite said additional recess.

8. A one-piece rocker arm according to claim 1 characterized by said second end portion of said metal body having side dimples extending inwardly toward said additional recess and said additional recess having corresponding inwardly-extending portions forming sides of said additional recess.

9. A one-piece rocker arm according to claim 1 characterized by said one-piece metal body being narrower at said second end portion than at said intermediate portion.

10. A one-piece rocker arm according to claim 9 characterized by said one-piece body being narrower at said first end portion than at said intermediate portion.

11. A one-piece, cold-formed rocker arm of the cam-follower type comprising a one-piece metal body having a recess in a first end portion thereof with said first end portion having an opening extending therethrough communicating with said recess to receive oil, said body having an additional recess at a second end portion thereof, said additional recess being of generally rectangular shape in transverse cross section, said second end portion having a shallow projection of generally rectangular shape in transverse cross section on the side opposite said additional recess, said body having an intermediate portion having a generally convex side facing away from said recesses, said convex side having a shallow rectangular recess therein defined by four peripheral side walls, said body having a shallow rectangular projection on the opposite side of said intermediate portion directly opposite said shallow recess, a long-wearing metal insert affixed in said shallow recess, said metal insert being prevented from sideways movement by said side walls of said body.

12. A one-piece rocker arm according to claim 11 characterized by said metal insert being affixed in said shallow recess by metal at the ends of said insert.

13. A one-piece rocker arm according to claim 11 characterized by a metal layer which is softer than said metal insert positioned in said shallow recess underneath said metal insert.

14. A one-piece rocker arm according to claim 11 characterized by said metal body having two spaced, parallel ridges extending from near said recess in said first end portion toward said shallow rectangular projection and said body having two spaced parallel grooves opposite said ridges extending from near said opening toward said metal insert.

15. A rocker arm according to claim 11 characterized by both end portions of said metal body being narrower than said intermedate portion of said metal body.

16. A one-piece rocker arm according to claim 11 characterized by a substantial portion of said metal body having a thickness from 0.25 to 0.45 inch.

17. A one-piece, cold-formed rocker arm of the cam-follower type comprising a one-piece metal body having a recess in a first end portion thereof, said end portion having an opening extending therethrough communicating with said recess, said body having an additional recess of rectangular transverse cross-sectional shape at a second end portion thereof, said body having downwardly-extending flanges with inward-extending dimples forming sides of said additional recess, said body having an intermediate portion with a generally convex side facing away from said recesses, said convex side having a shallow rectangular recess therein defined by four peripheral side walls, said body having a shallow projection on the side opposite said rectangular recess, a long-wearing metal insert in said rectangular recess, said metal insert being prevented from sideways movement by said side walls of said body, and said intermediate portion having downwardly-extending flanges forming extensions of said flanges at said second end portion.

18. A one-piece rocker arm according to claim 17 characterized by downwardly-extending side flanges on said first end portion forming extensions of said flanges on said intermediate portion of said metal body.

19. A one-piece rocker arm according to claim 17 characterized by said second end portion of said metal body being narrower than said intermediate portion of said metal body.

20. A one-piece rocker arm according to claim 17 characterized by a substantial portion of said metal body having a thickness from 0.130 to 0.200 inch.

* * * * *